US011486125B2

(12) United States Patent
Joukov et al.

(10) Patent No.: US 11,486,125 B2
(45) Date of Patent: Nov. 1, 2022

(54) SYSTEMS AND METHODS OF CLEANING TOILETS

(71) Applicants: Herman Joukov, Shaar Efraim (IL); Oleg Zukov, Shaar Efraim (IL)

(72) Inventors: Herman Joukov, Shaar Efraim (IL); Oleg Zukov, Shaar Efraim (IL)

( * ) Notice: Subject to any disclaimer, the term of this patent is extended or adjusted under 35 U.S.C. 154(b) by 0 days.

(21) Appl. No.: 17/433,158

(22) PCT Filed: Apr. 30, 2018

(86) PCT No.: PCT/IB2018/052978
§ 371 (c)(1),
(2) Date: Aug. 23, 2021

(87) PCT Pub. No.: WO2018/203209
PCT Pub. Date: Nov. 8, 2018

(65) Prior Publication Data

US 2022/0064927 A1 Mar. 3, 2022

(51) Int. Cl.

| | |
|---|---|
| ***E03D 9/00*** | (2006.01) |
| ***A46B 13/02*** | (2006.01) |
| ***A46B 15/00*** | (2006.01) |
| ***A47K 17/00*** | (2006.01) |

(52) U.S. Cl.
CPC ..... *E03D 9/002* (2013.01); *A46B 13/02* (2013.01); *A46B 15/0095* (2013.01); *A47K 17/00* (2013.01); *A46B 2200/304* (2013.01)

(58) Field of Classification Search
None
See application file for complete search history.

(56) References Cited

U.S. PATENT DOCUMENTS

2018/0078098 A1* 3/2018 Diallo ..... A47K 3/281

FOREIGN PATENT DOCUMENTS

| | | | | |
|---|---|---|---|---|
| CN | 105804188 | | 7/2016 | |
| CN | 105804188 A | * | 7/2016 | |
| CN | 105804188 B | * | 9/2017 | ..... E03D 9/002 |

OTHER PUBLICATIONS

English Machine Translation of CN-105804188-A provided by applicant.*
English Machine Translation of CN-105804188-B.*

* cited by examiner

*Primary Examiner* — Natasha N Campbell
*Assistant Examiner* — Pradhuman Parihar
(74) *Attorney, Agent, or Firm* — Mark David Torche; Patwrite Law

(57) ABSTRACT

Systems and methods of cleaning toilets are described; the system includes a structural frame, a foldable arm extendible from the structural frame and a rotatable brush, accommodated while being folded within and retracted into the foldable arm, at an idle state, while protruded from the foldable arm and being sprawl, during the operation of a cleansing cycle.

6 Claims, 7 Drawing Sheets

SYSTEMS AND METHODS OF CLEANING TOILETS

TECHNICAL FIELD

In general, the present invention pertains to the art of mechanics. In particular, the invention relates to systems and methods of cleaning toilets and specifically to systems and methods of cleaning toilets implementing an integrated toilet brush.

BACKGROUND ART

The common methods of cleaning toilets typically include the use of a disinfectant and/or detergent which is manually applied and then, if necessary, is scrubbed with a toilet brush populated with stiff bristles. A slow release dispenser with solid, soluble or liquid detergent can be attached to the toilet, usually with a securing arm over the rim of the toilet, so that the detergent is dispensed each time the toilet is flushed. Another option is a dissolvable solid detergent which is inserted into the water tank and slowly dissolves over time, each time the water tank is filling filled with water.

It is believed that the current state of the art is represented by the following patent literature: U.S. Pat. Nos. 9,783,975, 3,837,017, 6,662,379, 4,813,084, 7,055,183, 7,638,475, 8,359,679, 9,464,424, US20030098044, WO2007061740, EP2004792, EP3022365, EP0989247, DE202011109781U, CN101245608, CN103505756 and CN206784531U. All of the prior art solutions however fail to adequately address the providing of both, a detergent as well as an effective active cleaning means, to replace the manual act of scrubbing a toilet.

It would, therefore, be highly advantageous to have an electromechanically driven system, which cleans and disinfects the internal surface of a toilet, without the need for human contact with the cleaning accessories.

SUMMARY OF THE INVENTION

The following summary of the invention is provided in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

The invention was made in view of the deficiencies of the prior art and provides systems, methods and processes for overcoming these deficiencies. According to some embodiments and aspects of the present invention, there is provided an electronically or mechanically driven system which cleans and disinfects a toilet without the need for human contact with the cleaning accessories.

In accordance with one aspect of the present invention a system and method for cleaning toilets is provided that includes a rotatable brush, which is retractable into and protractable from the system for cleaning toilets.

In accordance with another aspect of the present invention a system and method for cleaning toilets is provided that combines the disinfectant and/or detergent dispersal with physical cleaning means.

Definitions

Whenever the terms "computing device" is used herein, it should be construed as a computer program, including any portion or alternative thereof, e.g. script, command, application programing interface (API), graphical user interface (GUI), etc., and/or computational hardware components, such as logic devices and application integrated circuits, computer storage media, computer micro-processors and random access memory (RAM), a display, input devices and networking terminals, including configurations, assemblies or sub-assemblies thereof, as well as any combination of the former with the latter.

The term storage as referred to herein is to be construed as including one or more of volatile or non-volatile memory, hard drives, flash storage devices and/or optical storage devices, e.g. CDs, DVDs, etc. The term "computer-readable media" as referred to herein can include transitory and non-transitory computer-readable instructions, whereas the term "computer-readable storage media" includes only non-transitory readable storage media and excludes any transitory instructions or signals. The terms "computer-readable media" and "computer-readable storage media" encompass only a computer-readable media that can be considered a manufacture (i.e., article of manufacture) or a machine. Computer-readable storage media includes "computer-readable storage devices". Examples of computer-readable storage devices include volatile storage media, such as RAM, and non-volatile storage media, such as hard drives, optical discs, and flash memory, among others.

Whenever in the specification hereunder and particularly in the claims appended hereto a verb, whether in base form or any tense, a gerund or present participle or a past participle are used, such terms as well as preferably other terms are to be construed as actual or constructive, meaning inter alia as being merely optionally or potentially performed and/or being only performed anytime in future.

In addition, as used herein, the term "or" is an inclusive "or" operator, equivalent to the term "and/or," unless the context clearly dictates otherwise; whereas the term "and" as used herein is also the alternative operator equivalent to the term "and/or," unless the context clearly dictates otherwise.

It should be understood, however, that neither the briefly synopsized summary nor particular definitions hereinabove are not to limit interpretation of the invention to the specific forms and examples but rather on the contrary are to cover all modifications, equivalents and alternatives falling within the scope of the invention.

DESCRIPTION OF THE DRAWINGS

The present invention will be understood and appreciated more comprehensively from the following detailed description taken in conjunction with the appended drawings in which.

Figure 1:
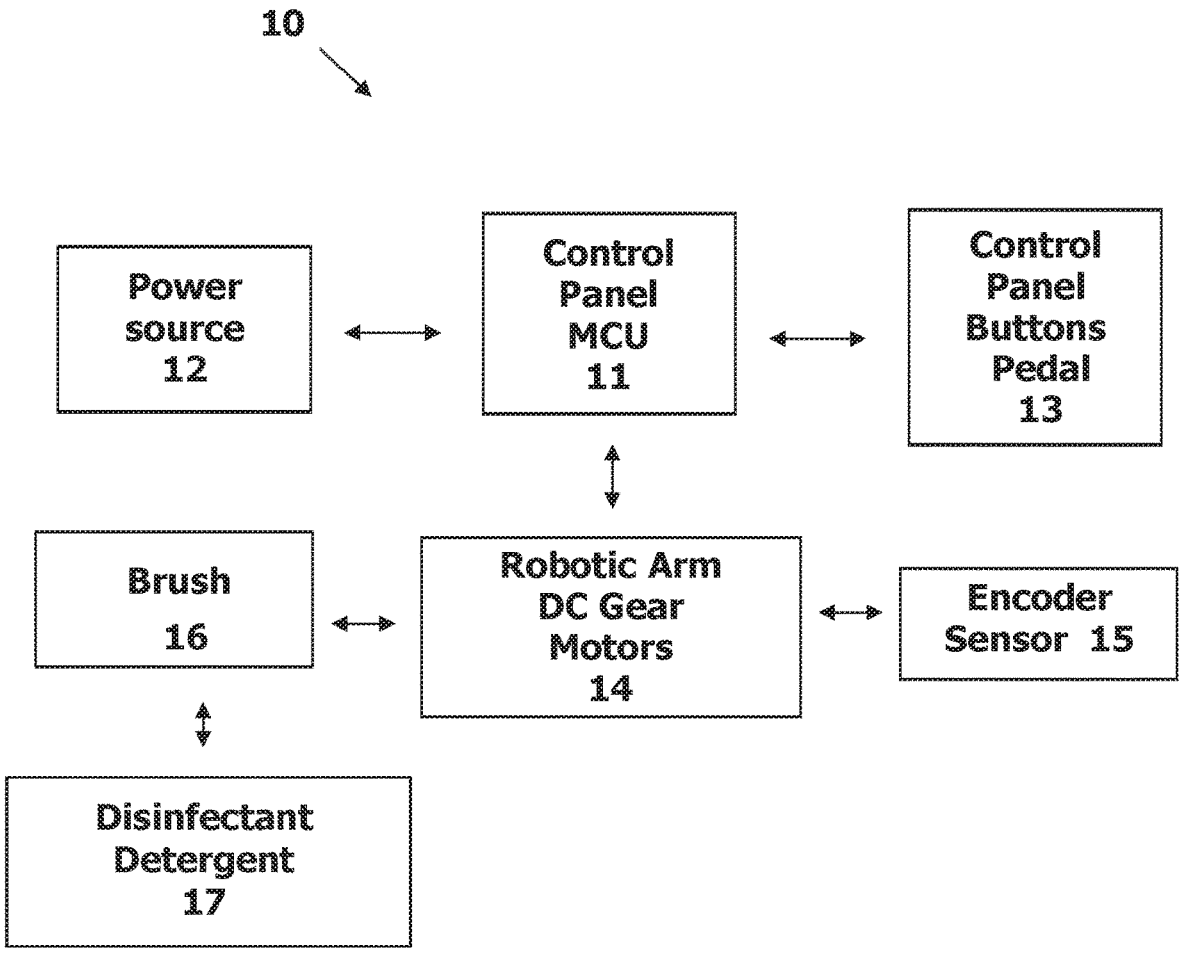
FIG. 1 is a schematic block diagram of an embodiment of a toilet cleaning system, of the present invention.
Figure 2:
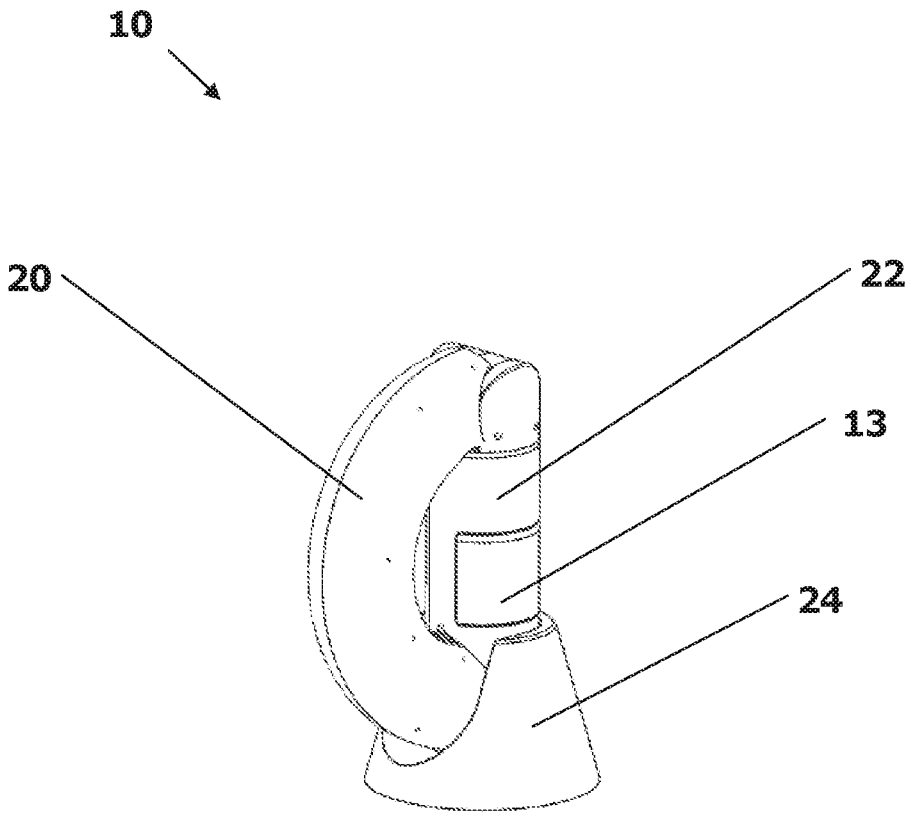
FIG. 2 is an isometric view of an embodiment of a toilet cleaning system, of the present invention, in a folded state.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DISCLOSURE OF EMBODIMENTS

Illustrative embodiments of the invention are described below. In the interest of clarity, not all features of actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming but nevertheless would be a routine undertaking for those of ordinary skill in the art having the benefit of this disclosure.

In accordance with some embodiments of the present invention, reference is now made to FIG. 1, showing a schematic block diagram of toilet cleaning system 10, in accordance with an embodiment of the present invention. Toilet cleaning system 10, shown in FIG. 1, comprises main control unit (MCU) 11, which is operationally connected to power source 12. Power source 12 is typically an electric battery or accumulator, whereas MCU 11 is typically an electronic device including a logic chip and/or computing device, such as computing device 400, shown in FIG. 7. Power source is optionally a DC transformer and/or electric connection to the power grid.

MCU 11 typically comprises control panel and/or user interface 13, such as a graphical user interface (GUI). Control panel and/or user interface 13 typically include actuators, such as buttons, levers, knobs and/or a pedal and/or touchless activator sensors, configured for actuating system 10 and/or initiating a cleaning cycle of system 10. The actuators of control panel and/or user interface 13 in a non-limiting manner are configured for powering system 10 on/off, changing the cleaning modes of system 10, setting the values of oscillations and/or speed and/or various other parameters of system 10.

Toilet cleaning system 10 further comprises geared electric motor 14, mounted on a robotic arm. Geared electric motor 14 is operationally connected to brush 16, configured for engaging in physical contact with the toilet bowl and exerting a robbing force onto the surface thereof.

Toilet cleaning system 10 further comprises disinfectant and/or detergent module 17, is operationally associated with brush 16. Disinfectant and/or detergent module 17 comprises a reservoir (not shown) containing a disinfecting and/or detergent agent (henceforth a cleaning agent) and a controllable dispenser (not shown), operationally connected to and controlled by MCU 11. The controllable dispenser (not shown) of detergent module 17 is configured for discharging a predefined amount of the disinfecting and/or detergent agent onto the surface of the toilet, within proximity of brush 16.

Toilet cleaning system 10 further comprises an encoder and/or sensor 15 connected to the haft of electric motor 14. Encoder and/or sensor 15 is configured for providing to MCU 11 data about a real time position and oscillation speed of the shaft of electric motor 14.

Rotating brush 16 is preferably connected to electric motor 14 by a means of a flexible shaft (not shown) and provides control over distance and positioning, so as to sustain an effective reaching to and engaging with any point on the inner surface of the toilet bowl (not shown). Disinfectant and/or detergent module 17 comprises a fluids conduit associated with rotating brush 16.

In accordance with some embodiments of the present invention, reference is now made to FIGS. 2 to 6, showing isometric views of toilet cleaning system 10, in various states of deployment, in accordance with an embodiment of the present invention. In a folded state, shown in FIG. 2, foldable arm 20, with rotating brush 16 (not shown) folded inside, contains geared motor 14 and encoder 15. Foldable arm 20 is pivotably mounted onto structural frame 22, which constitutes the structural frame of toilet cleaning system 10.

Structural frame 22 is supported by pedestal 24. Structural frame 22 typically accommodates MCU 11 (not shown). Structural frame 22 includes actuation pedal 13. Pedestal 24 optionally accommodates electrical batteries and/or accumulators (not shown), in off-grid embodiments. Pedestal 24 is optionally attached to the floor by a means of mechanical connectors, e.g. bolts or rivets, or by a means of suction and/or adhesion, e.g. stickers or vacuum cups.

Figure 3:
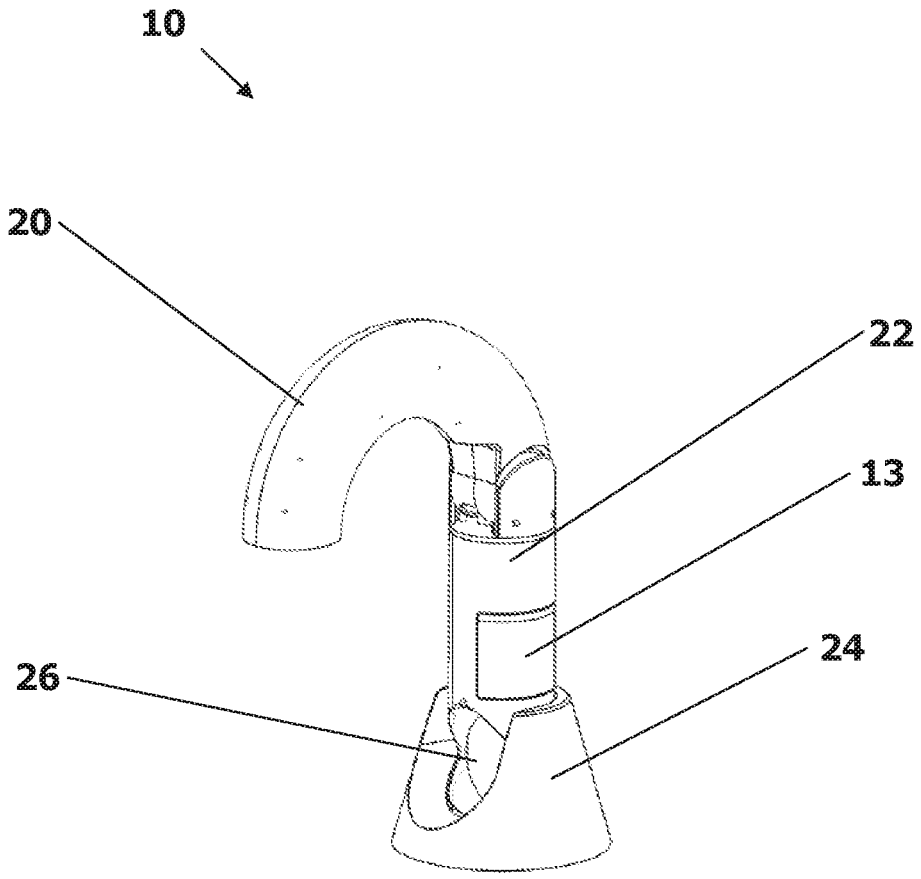
FIG. 3 is an isometric view of an embodiment of a toilet cleaning system, of the present invention, in an unfolded state, with a brush disposed inside the toilet cleaning system.

In an unfolded state, shown in FIG. 3, foldable arm 20 is elevated relatively to structural frame 22. Pedestal 24, as can be seen in FIG. 3, optionally further accommodates reservoir 26 containing a disinfecting and/or detergent agent, as well as a controllable dispenser (not shown).

Figure 4:
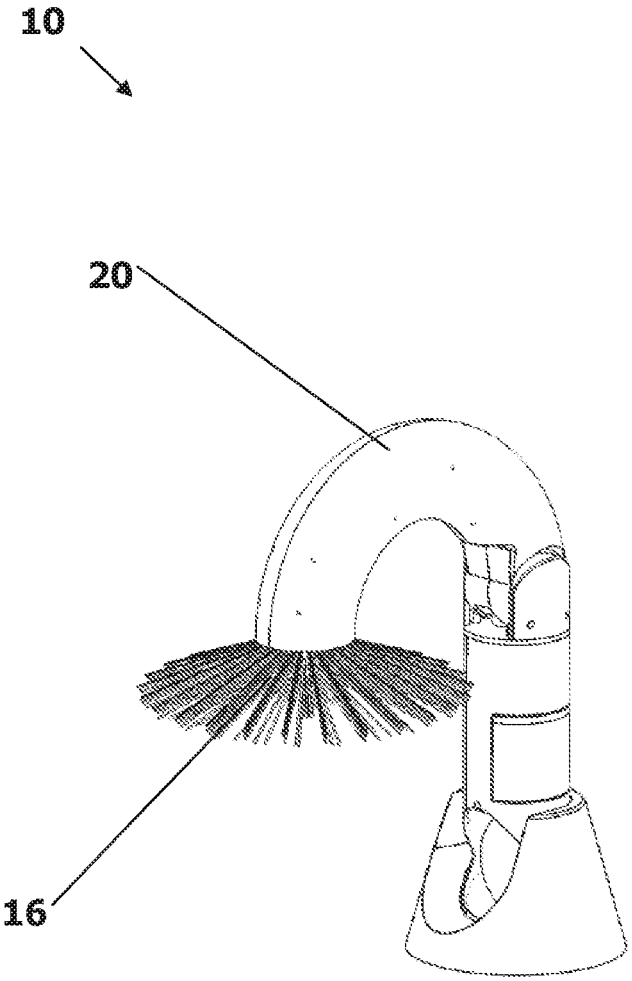
FIG. 4 is an isometric view of an embodiment of a toilet cleaning system, of the present invention, in an unfolded state, with a brush being deployed outside the toilet cleaning system.
Figure 5:
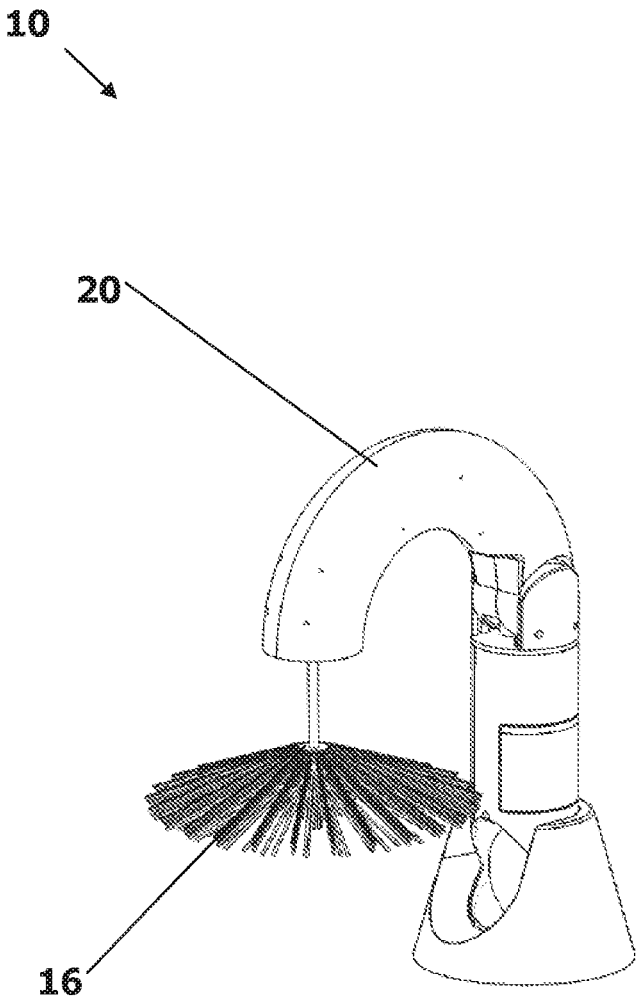
FIG. 5 is an isometric view of an embodiment of a toilet cleaning system, of the present invention, in an unfolded state, with a brush been completely deployed outside the toilet cleaning system.

In the commencement of the unfolded state, shown in FIG. 4, rotating brush 16 starts protruding from the distal end of foldable arm 20. In the conclusion of the unfolded state, shown in FIG. 5, rotating brush 16 is deployed and fully protrudes from foldable arm 20. As will be elaborated hereunder, in a completely deployed and/or unfolded state, rotating brush 16 assumes a substantial size, occupying essentially the entire inner lumen of a toilet bowl, of a toilet; whereas in a completely folded state, rotating brush 16 is fully accommodated within foldable arm 20.

Figure 6:
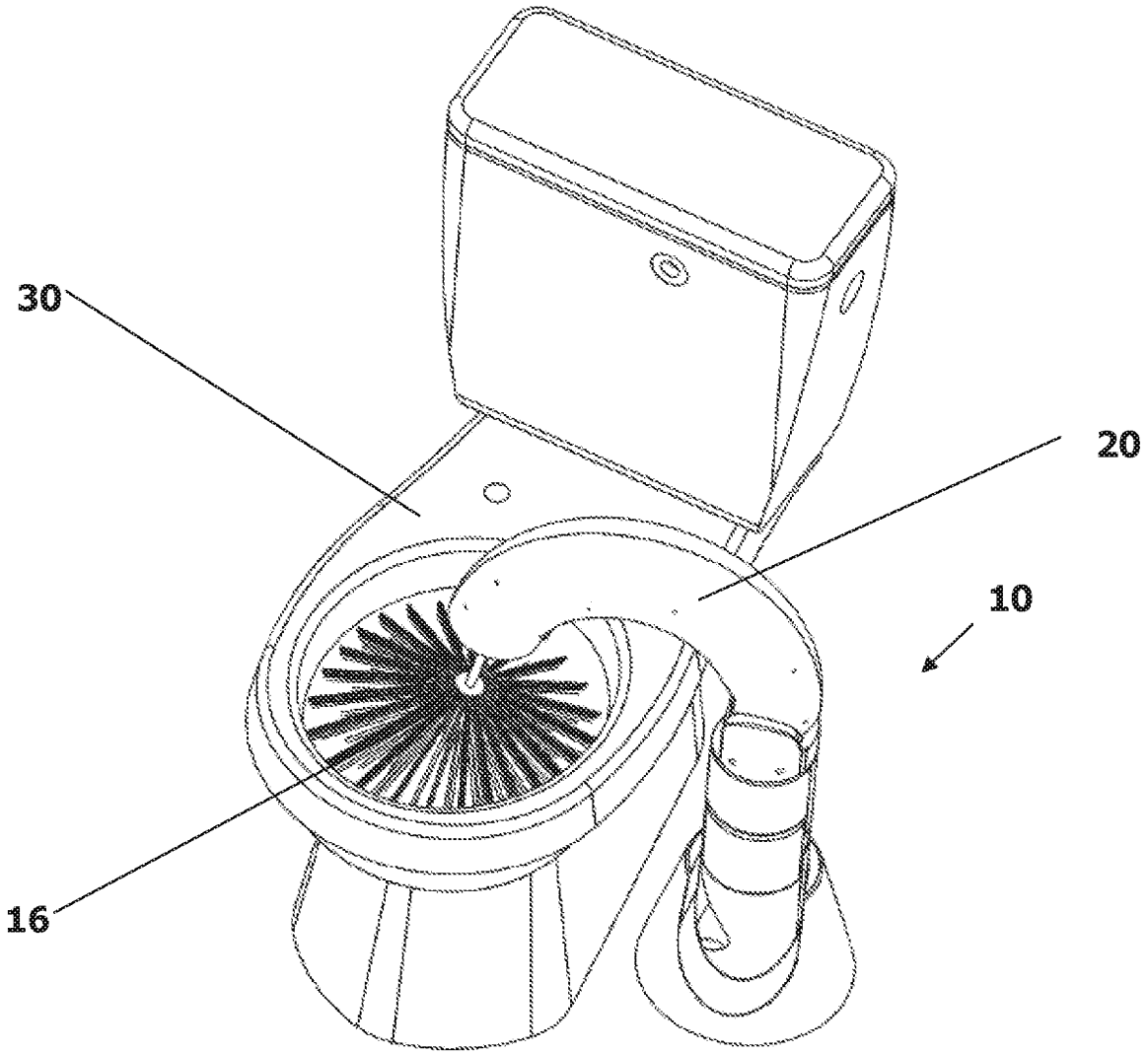
FIG. 6 is an isometric view of an embodiment of a toilet cleaning system, of the present invention, in an unfolded state, with a brush been completely deployed and inserted into a toilet.

With reference to FIG. 6, in the completely unfolded and deployed state, rotating brush 16 is fully deployed from foldable arm 20, so that the bristles of rotating brush 16 effectively reach to and engage with any point on the inner surface of the toilet bowl, of toilet 30. During the operation controllable dispenser (not shown) discharges disinfecting and/or detergent agent from reservoir 26 onto the surface of the bowl of toilet 30, to achieve a combined operation of mechanical and chemical cleansing.

Moreover, during the operation, encoder and/or sensor 15 continuously counts the revolutions of the haft of electric motor 14. Having the rotational torque of electric motor 14 and/or idle number of revolutions per minute for electric motor 14 known, rotating brush 16 is preferably urged against the inner surface of the toilet bowl, of toilet 30, until encoder and/or sensor 15 detects the reduction in rotational speed to a predefined value, thereby ensuring effective mechanical rubbing of the bristles of rotating brush 16 against the inner surface of the toilet bowl, of toilet 30.

Figure 7:
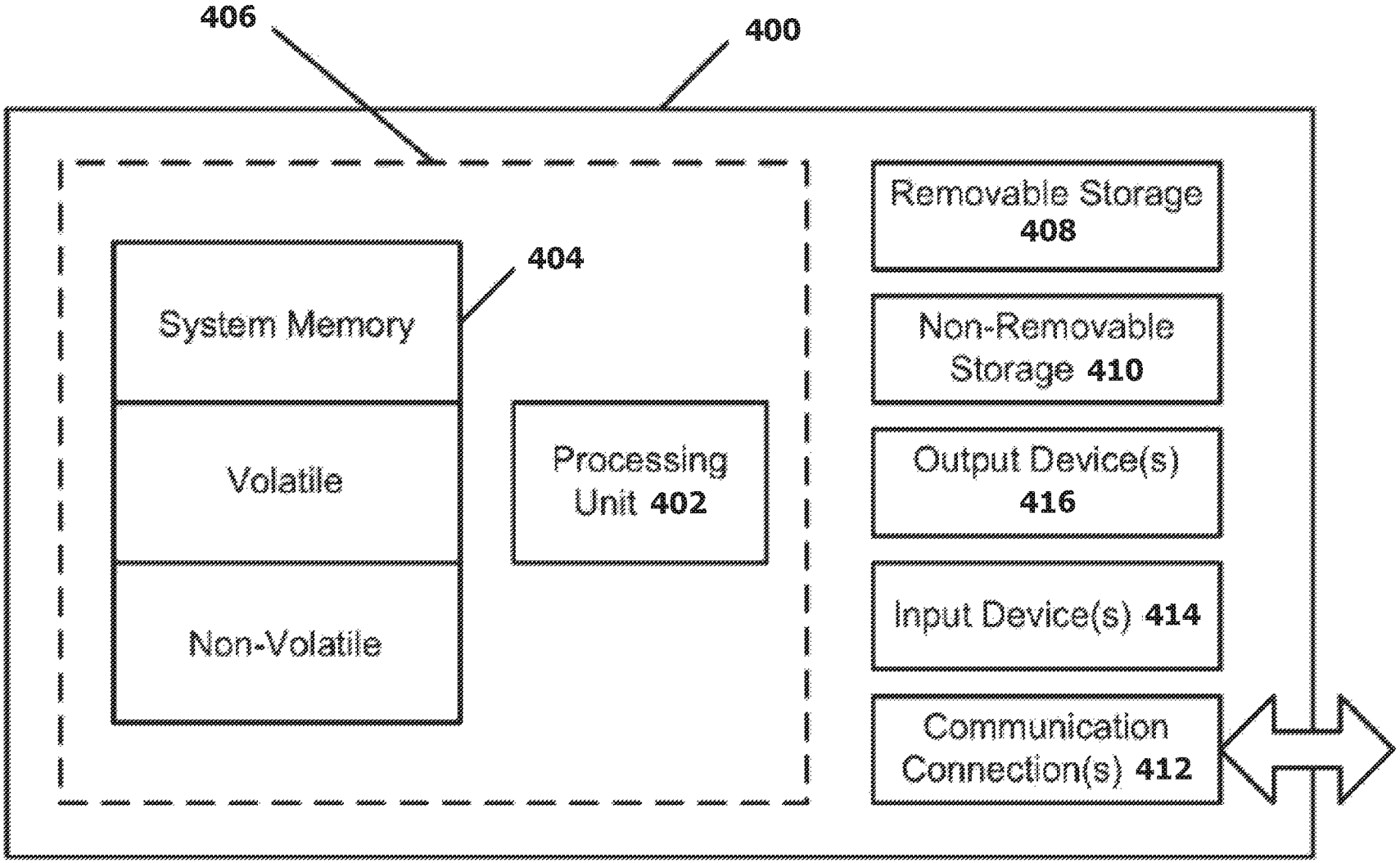
FIG. 7 is a schematic diagram of an exemplary computing environment.

With reference to FIG. 7, an exemplary computing device for implementing MCU 11 described herein includes computing device 400. In its most basic configuration, computing device 400 typically includes at least one processing unit 402 and memory 404. Depending on the exact configuration and type of computing device, memory 404 may be volatile (such as random-access memory (RAM), non-volatile (such as read-only memory (ROM), flash memory, etc., or some combination of the two. This most basic configuration is illustrated in FIG. 7 by dashed line 406.

Computing device 400 may have additional features/functionality. For example, computing device 400 may include additional storage (removable and/or non-removable) including, but not limited to, magnetic or optical disks or tape. Such additional storage is illustrated in FIG. 7 by removable storage 408 and non-removable storage 410.

Computing device 400 typically includes a variety of computer readable media. Computer readable media can be any available media that can be accessed by computing device 400 and include both volatile and non-volatile media, and removable and non-removable media. Computer storage media include volatile and non-volatile, and removable and non-removable media implemented in any method or technology for storage of information such as computer readable instructions, data structures, program modules or other data. Memory 404, removable storage 408, and non-removable storage 410 are all examples of computer storage media. Computer storage media include, but are not limited to, RAM, ROM, electrically erasable program read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 400. Any such computer storage media may be part of computing device 400.

Computing device 400 may contain communications connection(s) 412 that allow the device to communicate with other devices. Computing device 400 may also have input device(s) 414 such as a keyboard, mouse, pen, voice input device, touch input device, etc. Output device(s) 416 such as a display, speakers, printer, etc. may also be included. All these devices are well known in the art and need not be discussed at length here.

It should be understood that the various techniques described herein may be implemented in connection with hardware or software or, where appropriate, with a combination of both. Thus, the processes and apparatus of the presently disclosed subject matter, or certain aspects or portions thereof, may take the form of program code (i.e., instructions) embodied in tangible media, such as floppy diskettes, CD-ROMs, hard drives, or any other machine-readable storage medium where, when the program code is loaded into and executed by a machine, such as a computer, the machine becomes an apparatus for practicing the presently disclosed subject matter.

Although exemplary implementations may refer to utilizing aspects of the presently disclosed subject matter in the context of one or more stand-alone computer systems, the subject matter is not so limited, but rather may be implemented in connection with any computing environment, such as a network or distributed computing environment. Still further, aspects of the presently disclosed subject matter may be implemented in or across a plurality of processing chips or devices, and storage may similarly be effected across a plurality of devices. Such devices might include PCs, network servers, and handheld devices, for example. It will be appreciated by persons skilled in the art that the present invention is not limited by what has been particularly shown and described herein above. Rather the scope of the invention is defined by the claims which follow.

The invention claimed is:

1. A method of cleaning toilets comprises:

(a) providing a toilet cleaning system comprising:
  (I) a structural frame comprising a pivoting joint;
  (II) a foldable arm, mounted onto said pivoting joint;
  (III) a main control unit, comprising a user interface, configured for actuating a cleansing cycle of said system;
  (IV) a geared motor, operatively connected to said main control unit;
  (V) a rotatable brush, rotationally coupled to a rotor of said geared motor;

(b) conferring to said foldable arm a folded conformation, wherein a distal end of said foldable arm is disposed essentially adjacently to said structural frame;

(c) conferring to said foldable arm an unfolded conformation, wherein said distal end of said foldable arm is disposed away from said structural frame, further comprises protruding said rotatable brush from said distal end of said foldable arm;

(d) driving said rotatable brush into a folded conformation, wherein said rotatable brush is essentially retracted into, accommodated and enclosed within said foldable arm, while bristles thereof are folded within said foldable arm;

(e) driving said rotatable brush into a deployed conformation, wherein said rotatable brush is protracted from said distal end of said foldable arm and said bristles thereof are sprawl and configured to engage to an inner surface of a toilet bowl.

2. The method of cleaning toilets, as in claim 1, wherein said system further comprises a reservoir of a cleaning agent and a controllable dispenser, further comprises discharging a predefined amount of said cleaning agent onto said inner surface of said toilet bowl, within proximity of said rotatable brush.

3. The method of cleaning toilets, as in claim 1, wherein said rotatable brush is rotationally coupled to said rotor of said geared motor by a flexible shaft.

4. The method of cleaning toilets, as in claim 1, wherein said system further comprises at least one member selected from the group consisting of: an encoder and sensor; wherein said at least one member is connected to said rotor of said geared motor.

5. The method of cleaning toilets, as in claim 4, further comprises collecting data by said at least one member and using said data to ensure effective mechanical engagement of said bristles of said rotatable brush against said inner surface of said toilet bowl.

6. The method of cleaning toilets, as in claim 1, wherein in said deployed conformation, said rotating brush is configured to assume a size occupying a substantial portion of an entire inner lumen of said toilet bowl.

* * * * *